US005908238A

United States Patent [19]

Huang

[11] Patent Number: 5,908,238

[45] Date of Patent: Jun. 1, 1999

[54] CHRISTMAS LAMP DECORATION WITH EARED BULBLET AND WATERPROOF CAP

[76] Inventor: Shun-Feng Huang, 56, Minsheng Street, Fengyuan, Taichung Hsien, Taiwan

[21] Appl. No.: 09/004,616

[22] Filed: Jan. 8, 1998

[51] Int. Cl.[6] ..... F21V 21/00

[52] U.S. Cl. ..... 362/391; 362/249; 362/396; 362/806

[58] Field of Search ..... 362/226, 249, 362/250, 252, 391, 396, 806

[56] References Cited

U.S. PATENT DOCUMENTS 5,697,698 12/1997 Huang ..... 362/391 X
5,791,765 8/1998 Lin ..... 362/249

*Primary Examiner*—Stephen Husar

[57] ABSTRACT

A decoration lamp comprising a bulblet, a bulblet stand and a bulblet socket, the bulblet is inserted into the bulblet socket and the bulblet socket is inserted into the bulblet stand. The bulblet socket has two ears disposed outside and a trough is located on the outer curved surface of the ear. The bulblet stand has two L-shaped bars in corresponding to the two troughs of the ears. A cap in round shape with big and small hollow rooms and a opened top are for enclosing the bulblet and the bulblet stand. The L-shaped bar of the bulblet stand is inserted into the trough on the ear of the bulblet socket and the cap encloses the bulblet stand for waterproof objective.

1 Claim, 5 Drawing Sheets

CHRISTMAS LAMP DECORATION WITH EARED BULBLET AND WATERPROOF CAP

BACKGROUND OF THE INVENTION

The invention relates to a Christmas decoration lamp, more particularly relates to a lamp which consists an eared bulblet and a waterproof cap. The conventional Christmas lamp decoration is in series and can be hanged in Christmas trees and later the net-shaped Christmas lamp decoration was developed with ears to hang the wires. The present invention has a bulblet socket with ears and a cap to prevent water from getting in. It mainly comprising a bulblet, a bulblet stand and a bulblet socket. The bulblet is inserted into the bulblet socket, the bulblet is then inserted into the bulblet stand, two filament of the bulblet go through the bulblet socket and expose outside. Two ears are disposed at the circumference of a stopping ring on the bulblet socket, a vertical trough is located on the outer circumference of the ear. Two L-shpaed bars are disposed on the bulblet stand in corresponding to the vertical troughs of the ears. A cap with an opened top has a big and small hollow room for enclosing the bulblet and the bulblet socket. Accordingly, the L-shaped bar of the bulblet stand is inserted into the vertical trough of the ear of the bulblet socket, the big hollow room of the cap encloses the upper of the bulblet stand and the stopping ring of the bulblet socket, while the small hollow room encloses the bulblet, thus can prevent water from getting inside.

SUMMARY OF THE INVENTION

The first objective of the present invention is to provide a device of vertical ear and L-shaped bar for firm and stable assembly of the bulblet socket and the bulblet stand.

The second objective of the present invention is to provide a cap on top of the bulblet socket and the bulblet stand to keep water from coming inside.

DETAILED DESCRIPTION OF THE INVENTION

Figure 1:
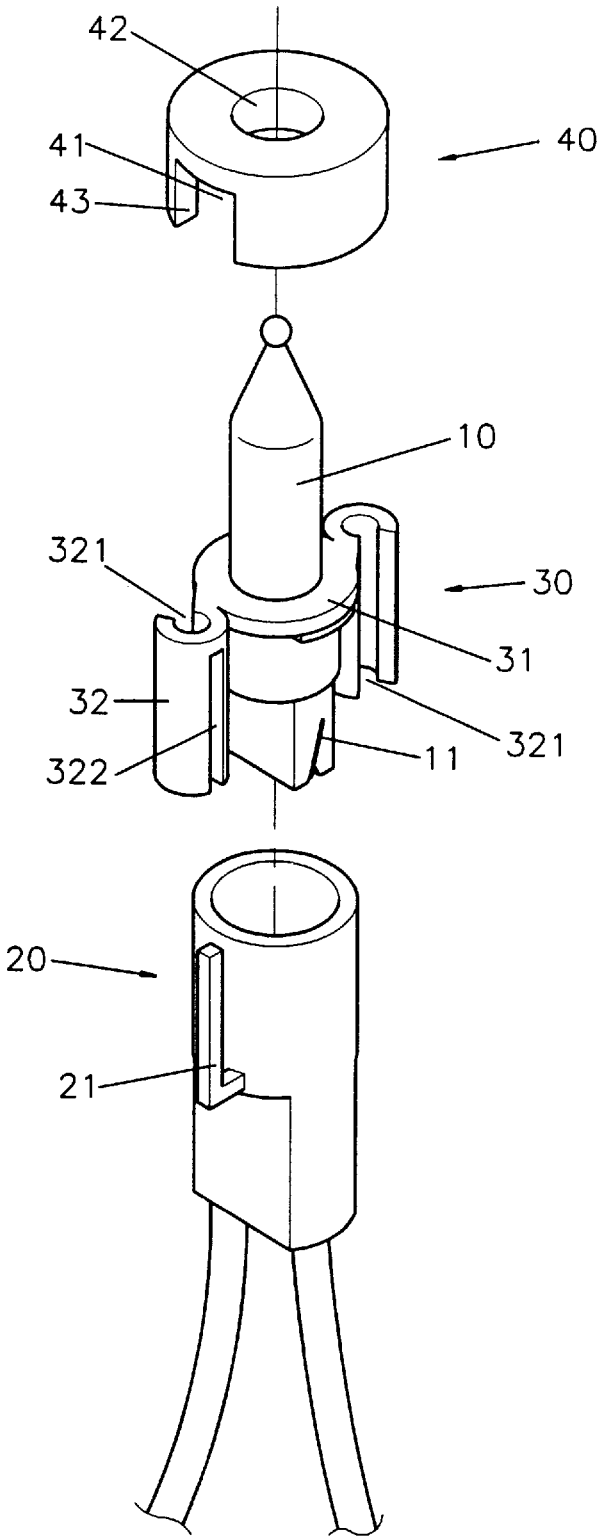
FIG. 1 is a perspective exploded view of the present invention.
Figure 2:
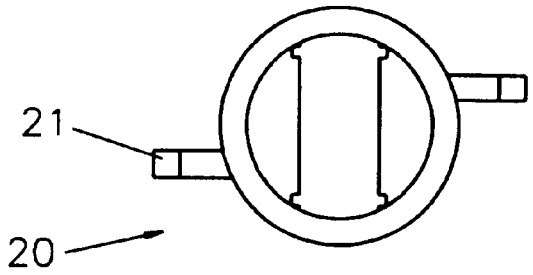
FIG. 2 is a top view of the present invention.
Figure 3:
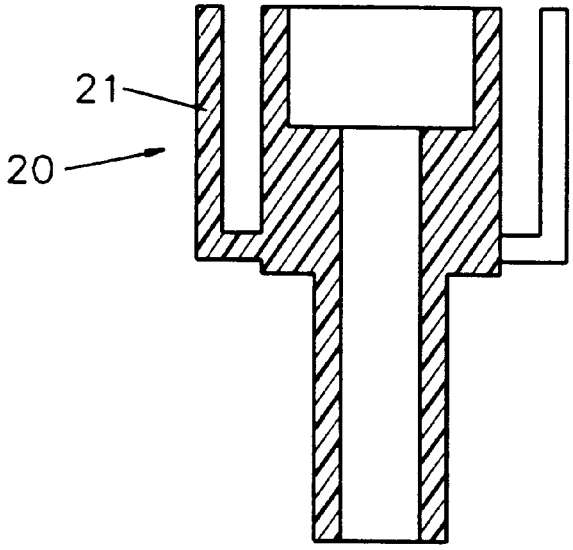
FIG. 3 is a sectional view of the present invention.
Figure 4:
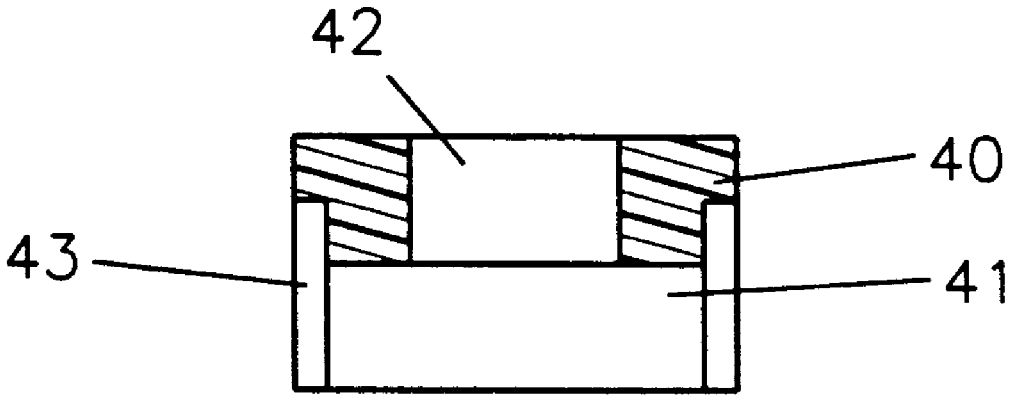
FIG. 4 is a sectional view of the cap of the present invention.

Referring to FIGS. 1, 2 and 3, the present invention comprises a bulblet 10, a bulblet stand 20, a bulblet socket 30 and a cap 40. The bulblet socket 30 has a stopping ring

31, the stopping ring 31 extends outwards and form a vertical ear 32, a opening 321 is formed because of the curl shape of the vertical ear 32. A vertical trough 322 is located at the outer curved surface of the vertical 32. The bulblet 10 is inserted into the bulblet socket 30, 1 filament 11 penetrates through the bottom of the bulblet socket 30 and exposes outside. A L-shaped bar 21 on the outer surface of the bulblet stand 20 is corresponded to the vertical trough 322 at the vertical ear 32 of the bulblet socket 30, the L-shaped bar is inserted into the vertical trough 322. A cap 40 has big and small hollow rooms 41 and 42 respectively, the hollow room 42 penetrates the top surface of the cap 40. An indentation 43 is formed on the side of the cap 40.

Figure 6:
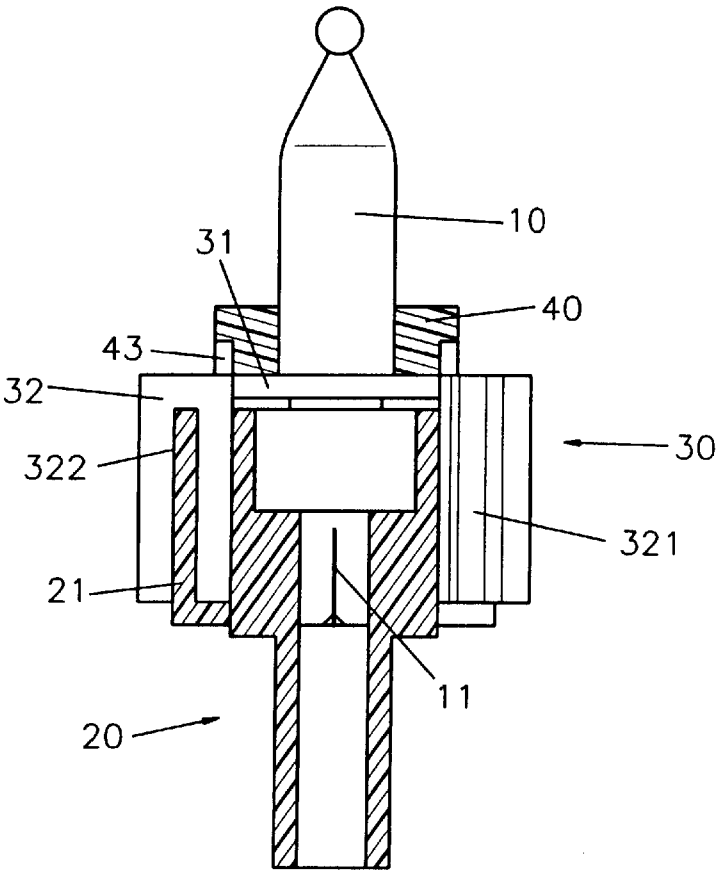
FIG. 6 is a sectional view of the present invention.
Figure 5:
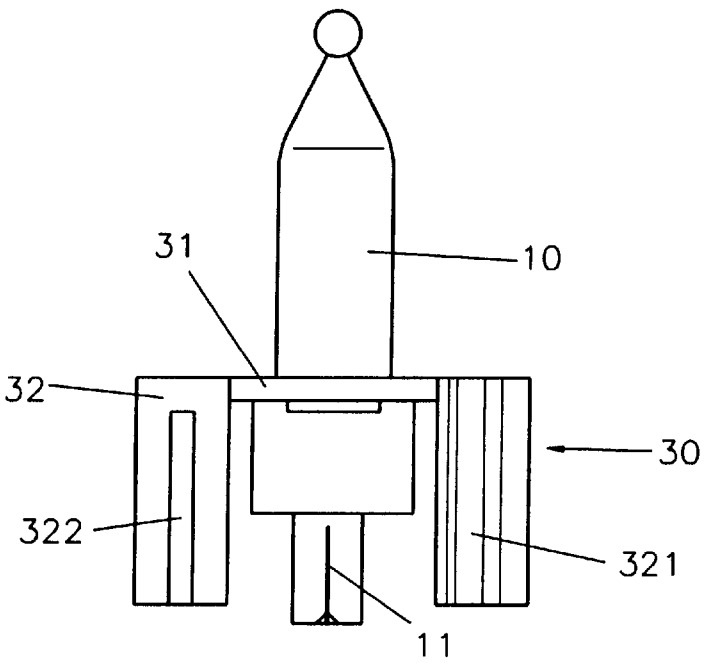
FIG. 5 is assembled view of the bulblet and the bulblet socket.
Figure 7:
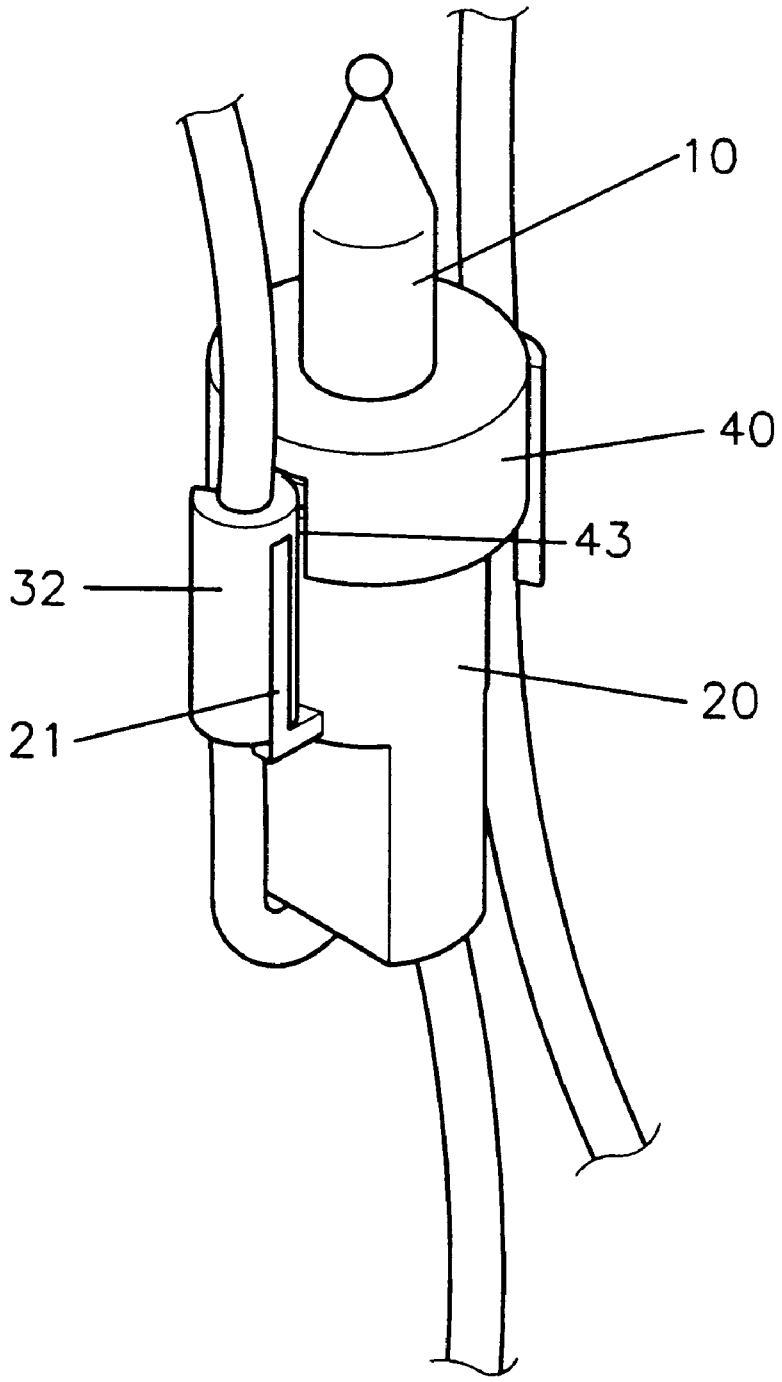
FIG. 7 is a perspective assembled view of the present invention.

Referring to FIGS. 5, 6 and 7, insert the bulblet 10 into the bulblet socket 30, the filament 11 of the bulblet 10 exposes outside the bottom of the bulblet socket 30. The bulblet socket 30 is inserted into the bulblet stand 20, so that the vertical trough 322 of the vertical ear 32 joints together with the L-shaped bar 21 of the bulblet stand 20, provides a more firm and stable assembly structure between the bulblet socket 30 and the bulblet stand 20. The vertical ear 32 can also be used for positioning wire. The cap 40 is then placed on top of the bulblet stand 20, the upper part of the bulblet stand 20 and the stopping ring 31 of the bulblet socket 30 are enclosed inside the big hollow room 41, and the bulblet 10 is also enclosed inside the small hollow room 42, the indentation 43 is placed between the vertical ear 32 and the stopping ring 31. A copper plate 51 of a wire 50 is connected on the inner surface of the bulblet stand 20, so that the filament 11 of the bulblet 10 can be connected with the copper plate 51.

I claim:

1. A decoration lamp comprising a bulblet, a bulblet socket with a stopping ring and two vertical ears disposed on the edge of said stopping ring, a vertical trough is disposed on the outer curved surface of said vertical ear, a bulblet stand with a L-shaped bar disposed outside, said bulblet is inserted into said bulblet socket and said bulblet socket is inserted into said bulblet stand, two filaments disposed on the bottom of said bulblet go through the bottom of said bulblet socket and being exposed outside, a cap in round shape with big and small hollow rooms and opened top for enclosing said bulblet stand and said bulblet, said L-shaped bar of said bulblet stand is inserted into said vertical trough at said vertical ear of said bulblet socket, upper part of said bulblet stand and said stopping ring of said bulblet socket are enclosed inside said big hollow room, said bulblet is enclosed inside said small hollow room.

* * * * *